United States Patent [19]

Alexander

[11] 4,137,724

[45] Feb. 6, 1979

[54] APPARATUS FOR PRODUCING ICE

[75] Inventor: Robert W. Alexander, Pasadena, Calif.

[73] Assignee: Armalite, Inc., Costa Mesa, Calif.

[21] Appl. No.: 462,887

[22] Filed: Apr. 22, 1974

[51] Int. Cl.[2] ..... F25C 1/04

[52] U.S. Cl. ..... 62/138; 62/352

[58] Field of Search ..... 62/352, 353, 138

[56] References Cited

U.S. PATENT DOCUMENTS

| | | | |
|---|---|---|---|
| 2,994,205 | 8/1961 | Brubaker et al. | 62/353 X |
| 3,003,329 | 10/1961 | Frei et al. | 62/353 X |
| 3,008,301 | 11/1961 | Baillif et al. | 62/353 X |
| 3,287,927 | 11/1966 | Jacobus | 62/353 X |
| 3,312,082 | 4/1967 | Gram | 62/353 |
| 3,367,127 | 2/1968 | Walker | 62/353 X |
| 3,380,261 | 4/1968 | Hendrix et al. | 62/353 X |
| 3,388,560 | 6/1968 | Moreland | 62/353 |
| 3,803,871 | 4/1974 | Karas | 62/352 X |

*Primary Examiner*—William E. Wayner
*Assistant Examiner*—William E. Tapolcai, Jr.
*Attorney, Agent, or Firm*—William H. Maxwell

[57] ABSTRACT

An apparatus for the automatic production of ice from water filled stalls and comprised of means applying heat absorption thereto until an iced condition is reached, followed by the simultaneous application of heat thereto to thaw the stall-to-ice interfaces and of refill water thereto to eject the ice by means of floatation; and comprised of one or a series of stalls embraced by the evaporator of a refrigeration system having a hot gas bypass that is intermittently discharged through the evaporator simultaneously with refill water applied to the stall or stalls to eject the ice, a temperature sensor and refrigerant control alternately reacting to effect the iced and thaw conditions of the stall, thereby automatically cycling the apparatus for continued operation.

7 Claims, 8 Drawing Figures

APPARATUS FOR PRODUCING ICE

BACKGROUND

The production of ice as previously practiced requires apparatus involving a variety of moving parts and devices for establishing a solid product, to harvest, and its transport to storage. Mechanical refrigeration is usually involved, by which gas is compressed, liquified and then expanded; in which the principles of evaporation are utilized to absorb heat from water and thereby transforming it into ice. The water to be frozen must be supplied in measured quantity and contained within vessels from which it is extracted as ice; a time schedule must be established for the heat absorption period, extraction period, and the vessel refill period, and all of which requires time and temperature control of the water supply and coordinated operation of the refrigeration equipment. In practice, unforeseeable variables enter into ice production in the form of atmospheric conditions, inlet water temperatures, and variations in plant efficiencies; all of which are unpredictable and require complex sensing and control means. Therefore, it is a general object of this invention to provide for minimal complexity in the process and/or operation of apparatus producing ice, and a system therefor which is inherently operable continuously at optimum efficiencies dependent upon prevailing conditions.

The present invention employs mechanical refrigeration in its basic form and combined therewith the fewest number of elements, and excepting the refrigeration means per se this invention virtually eliminates moving parts and relies upon the thermo control of refrigerant flow and product water supply. Accordingly, it is an object of this invention to provide an apparatus that operates in reliance upon the principles of freezing, thawing and ejection of the product. With the present invention, the product cycle involves applied heat absorption to a stall filled with water and applied until iced, followed by applied heating of the stall filled with ice until the ice-to-stall interfaces are thawed and accompanied by application of water under pressure to refill said stall by floating the ice as a product therefrom, and the product cycle repeated by reinstating the applied heat absorption in place of said heating. Floatation water is recovered and reapplied as refill water to this "freeze-thaw-ejection cycle".

Quantity production of ice, regardless of size, on an economical basis is an object of this invention, and to this end the aforementioned freeze-thaw ejection cycle is progressively applied to a series of stalls for the efficient and continuous production of ice. With the preferred form of the present invention, the product cycle involves progressively applied heat absorption through a series of stalls filled with water and applied until all stalls are iced, followed by progressively applied heating through said series of stalls filled with ice until the ice-to-stall interfaces are thawed and accompanied by application of water pressure to refill said stalls by progressively floating the ice as a product therefrom, and the product cycle repeated by reinstating the progressively applied heat absorption in place of said progressive heating. The progressive application of the aforementioned freeze-thaw-ejection cycle involves the heat conductive capability of a series of ice stalls cooperatively related to heat absorption and heating applied sequentially thereto.

It is an object of this invention to provide apparatus for carrying out the method referred to, and to this end there is a stall filled with water from a pressure supply thereof and means alternately absorbing heat from and applying heat thereto, the water supply and said means being responsive to a stall temperature sensor and a control therefrom responsive to thawing and operating said means to absorb heat until the stall is iced and responsive to freezing and operating said pressure supply to apply water and simultaneously operating said means to apply heat until the stall is thawed.

It is also an object of this invention to provide apparatus for continuously carrying out the method referred to, and to this end there is a series of stalls filled with water from a common pressure supply thereof and means alternately absorbing heat progressively from and progressively applying heat thereto, the water supply and said means being responsive to a selectively positioned stall temperature sensor and a control therefrom responsive to thawing and operating said means to absorb heat until the stalls are iced and responsive to freezing and operating said pressure supply to apply water and simultaneously operating said means to apply heat until the stalls are thawed.

It is still another object of this invention to provide an ice stall and water filling manifold therefor combined so as to discharge product ice by means of floatation. With the present invention the ice stall is displaced from vertical and the product ice discharged therefrom by hydraulic floatation. In addition to floatation in the strict sense, the hydraulic action involves displacement whereby the ice is ejected as a piston.

It is a further object of this invention to provide apparatus of the character thus far referred to that is self-sufficient and entirely automatic, with means to conserve floatation water, and to conserve operating energy when a full harvest is obtained. The harvest bin is a cold-sink for storage, while the floatation water is maintained at a constant level for accurate pressure application by means of a pump. Control is entirely by thermal response, there being a single thermostatic switch to automatically control refrigerant flow and supply water to the stalls. The harvest switch operates independently in response to the temperature of ice reaching the brim of the storage bin.

DRAWINGS

The various objects and features of this invention will be fully understood from the following detailed description of the typical preferred forms and application thereof, throughout which description reference is made to the accompanying drawings, in which.

Figure 7:
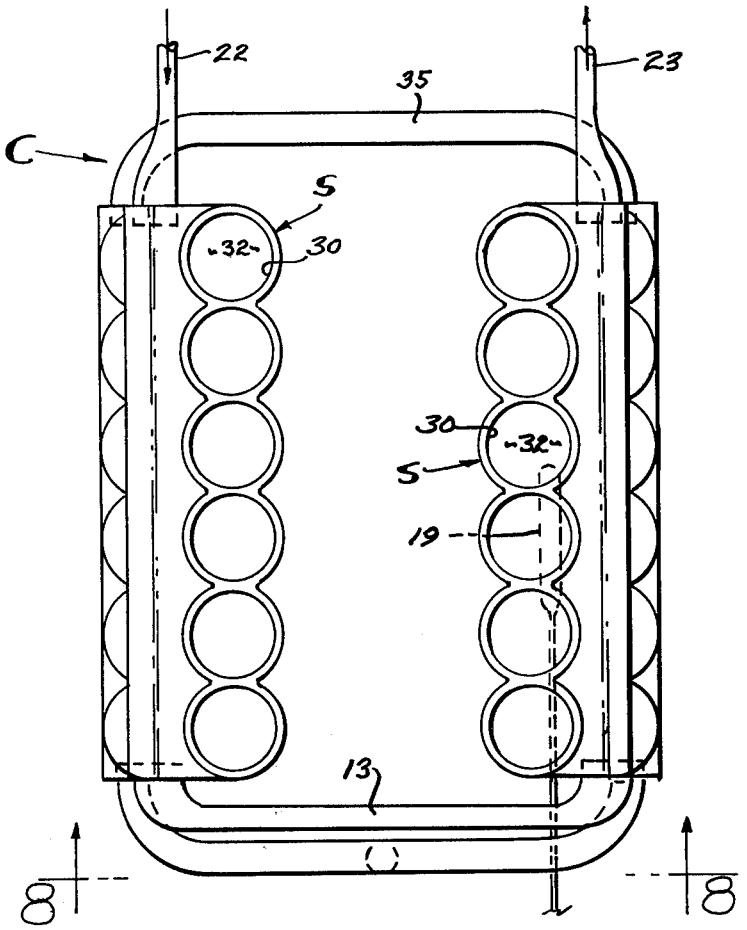
FIG. 7 is a plan view of the ice maker of the apparatus and taken as indicated by line 7—7 on FIG. 2.
Figure 8:
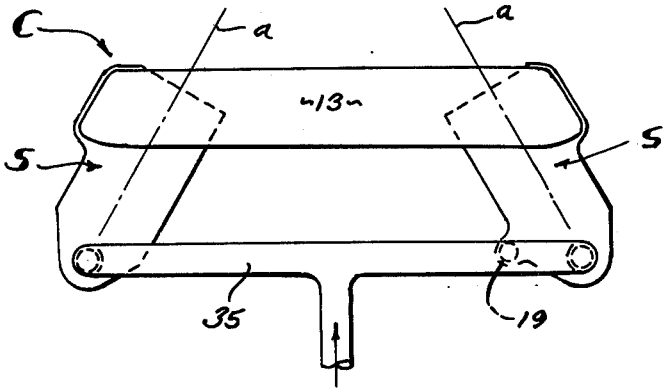

And, FIG. 8 is an end view of the ice maker taken as indicated by line 8—8 on FIG. 7.

PREFERRED EMBODIMENT

The method of the present invention involves a "freeze-thaw-ejection cycle" utilizing the inherencies of thermodynamics and hydraulics to produce ice. Freezing is attained by any suitable process or means adapted to absorb heat; thawing is attained by any suitable process or means adapted to deploy heat; and ejection is attained by the combined inherencies of the floatation and hydraulics of water supplied to form the ice. In practice, a refrigerating liquid-gas process is employed to advantage in which the principles of evaporation are utilized to form ice and the principles of fluid compression are utilized to deploy heat. It is preferred that a mechanical refrigeration process be employed wherein a refrigerant is compressed and cooled, and then expanded within an evaporator to absorb heat; and in such a system it is common practice to bypass the cooling step and use the heat of compression to defrost and the like.

Figure 1:
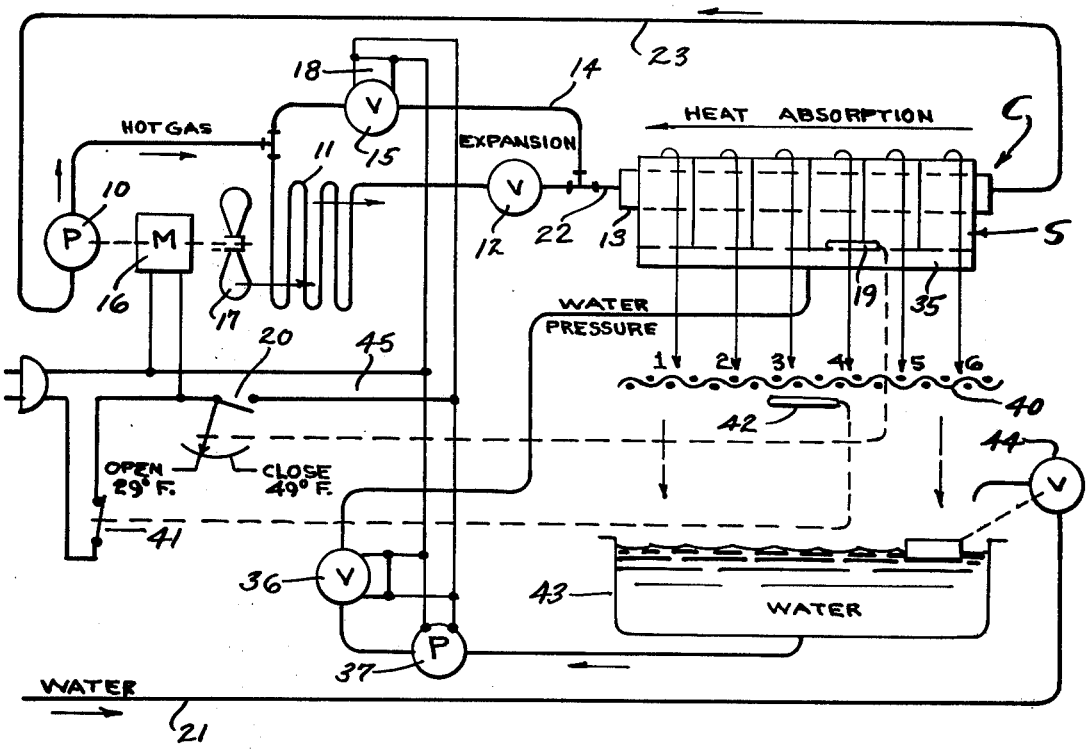
FIG. 1 is a schematic of an apparatus for carrying out the method of producing ice as hereinafter described.

As shown in FIG. 1, there is a compressor 10 that pressurizes the refrigerant and applies the heat of compression thereto, a condensor 11 that cools the refrigerant and thereby transforms it from the gaseous state to liquid state, a thermo expansion valve 12 that releases the transformed refrigerant, and an evaporator 13 into which the released refrigerant expands to absorb heat. Further, and in accordance with this invention, there is a hot gas bypass 14 that extends directly from the compressor 10 to the evaporator 13, there being a normally closed valve 15 therein so that the system is normally operative to absorb heat. The aforementioned elements of the refrigeration system are suitably plumbed and interconnected in a conventional manner, as shown.

The above described refrigeration system is continuously operated when there is a demand for ice, and it is driven by a motor 16 that drives both the compressor 10 and a fan 17 that circulates cooling air through the condensor 11. The valve 15 is operated by a solenoid 18, there being a sensor 19 combined with the evaporator and associated elements as later described, to actuate a switch 20 that controls operation of the valve 15 to cycle the apparatus. There is a water supply 21, suitably pressured to flow, and responsive to switch 20 to apply floatation and refill water.

Referring now to the method a freeze-thaw ejection cycle is provided for producing ice from water on a continuing basis. The method is initiated at a temperature above freezing, for example the ambient temperature. At this starting temperature, the water is filled into a stall in the form of an open topped vessel and heat absorption applied thereto until the water is iced, preferably solidly iced. When this iced condition is reached, which is 32° F., or less, the method is at its half cycle and heat is deployed to the iced stall accompanied by the application of refill water under pressure beneath the ice.

Figure 6:
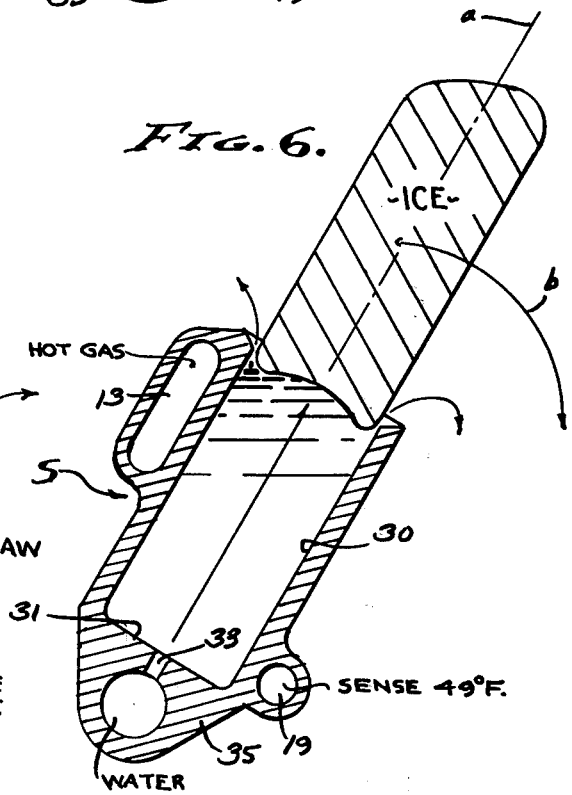

The vessel stall which contains the water transformed into ice necessarily involves interfaces for the containment of the water and resulting containment of the ice. It is these interfaces through which the heat absorption and deployment is applied. Accordingly, deployment of heat at the half cycle results in thawing at said interfaces and the pressure application of refill water at higher than freezing temperature floats the ice from the stall from which it has been freed by an intervening layer of water. The rate of flow of refill water is substantial so that the ice moves as a piston or ram instantly after its freedom is attained, and to the end that it rises out of the stall (see FIG. 6), all of which is readily accomplished as ice is of lesser weight by volume than the floatation water. When this risen condition is reached, the method is at its full cycle at which time the ice is harvested and heat absorption reapplied to initiate a subsequent cycle of the method.

The method produces ice in multi-form by progressively applied heat absorption through a series of stalls filled with water and applied until the water is iced. That is, heat absorption is applied so that ice matures first in one stall followed by the maturity of ice in successively adjacent stalls. When maturity of ice in all stalls is completed the method is at its half cycle and heat is deployed progressively to the iced stalls accompanied by the application of refill water under pressure beneath the ice therein, respectively. That is, the heat deployment is applied so that thawing occurs first in one stall followed by the thawing of ice in successively adjacent stalls; and preferably in the same sequence or pattern as in the aforementioned heat absorption application. When the risen condition is reached in all stalls, the method is at its full cycle for harvest and heat absorption reapplied to initiate a subsequent "batch" cycle of the method.

Referring now to the apparatus and its preferred form as shown throughout the drawings, the freeze-thaw-ejection cycle is applied in the operation of an ice cube making machine that automatically produces ice in multi-form on a continuous basis. In accordance with the invention, combined with the above described refrigeration system there is a cabinet A which comprises a storage bin B and accommodation for the aforementioned elements 10–21 and an ice maker C. The ice maker C is a unit that performs the above described processes when combined with a refrigeration system having an outlet line 22 adapted to alternately deliver heat absorbing fluid or heating fluid, and having an inlet line 23 returning the expended fluid. Lines 22 and 23 are connected to the evaporator 13 in a closed system in which refrigerant is recirculated through the said evaporator.

Figure 2:
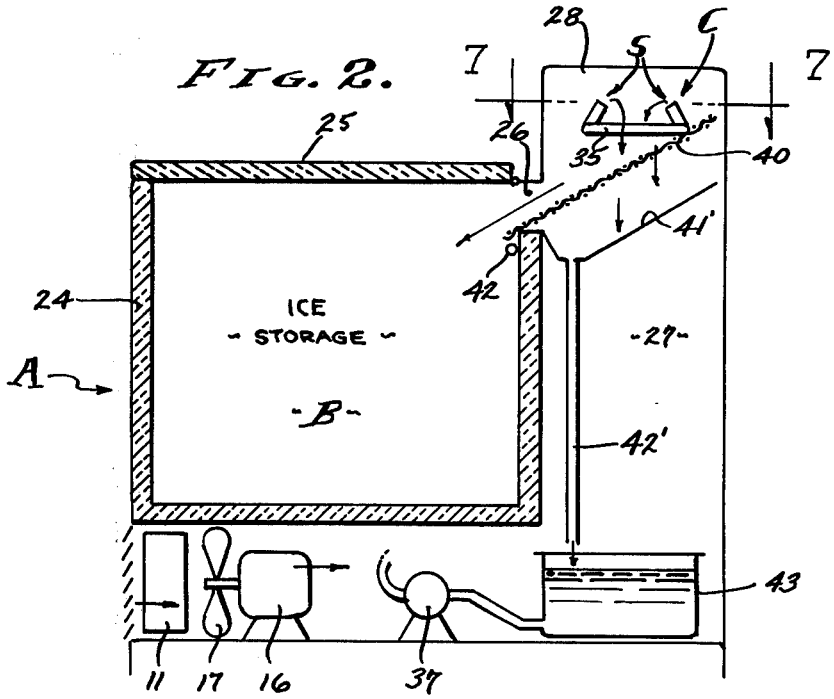
FIG. 2 illustrates a physical embodiment of an apparatus such as shown in FIG. 1.

Cabinet A is an upstanding structure occupied substantially by the bin B which has front, side, back and bottom walls that are imperforate and lined with heat insulation 24. The top 25, also lined with heat insulation, is hinged so as to open for access, and the back wall is characterized by a horizontal opening 26 along its upper margin. There is a chamber 27 in the back of the cabinet, and also underlying the same as shown, in which the refrigeration system and ice maker C are housed, the ice maker being installed adjacent the opening 26 to discharge ice through said opening and into the bin B by means of gravity. In practice, there is a super-structure 28 at the rear of the cabinet to house the ice maker, as best illustrated in FIG. 2.

Figure 3:
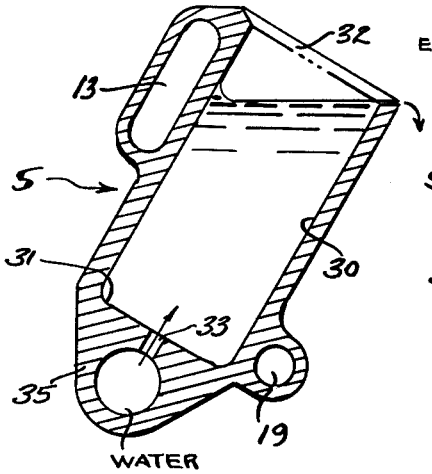
FIGS. 3 to 6 are enlarged detailed sectional views of an ice stall, showing sequentially the method steps of forming ice therein.

The ice maker C involves generally a stall S embraced by and/or in contact with or subjected to the heat functions of the evaporator 13. In practice, the stall S and evaporator 13 are attached or integral, so that heat transfer therebetween is direct. The stall S is an upwardly open vessel which can be of any cross sectional configuration as may be desired, for example square or round. As shown, the stall S has a right cylinder wall 30 closed by a bottom 31 at one end and open at the other end 32. The bottom 31 and open end 32 are normal to the axis a, and in the preferred form the axis a is displaced approximately 30° from vertical so that ice ejection is assured by a self-clearing action. The water supply 21 into the stall is by means of a port or orifice 33 through the bottom of the stall, and from FIG. 3 it will be seen that the water fills the stall to a level above the dipped side of the open end 32. The evaporator 13 embraces one side of the stall, while the sensor 19 contacts the opposite side thereof, the sensor being remote from the evaporator.

Figure 4:
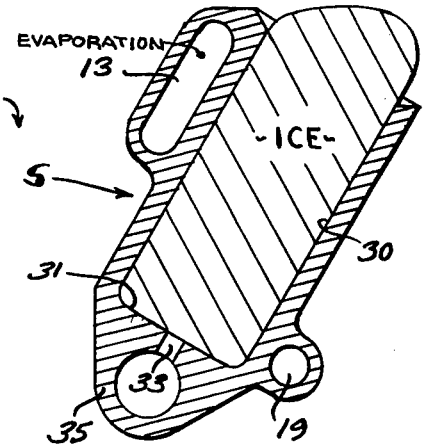
Figure 5:
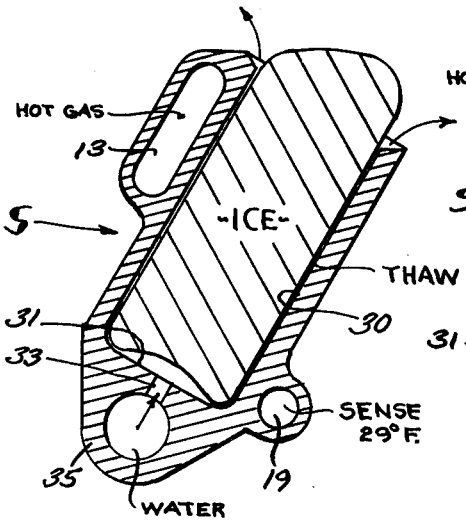

With the stall hereinabove described, the evaporation of refrigerant is initiated by switch 20 that is actuated to remain open when the sensor 19 detects a rise to 49° F., for example, thereby forming ice as shown in FIG. 4. Note that expansion takes place with a resultant extrusion of an ice dome from the open end of the stall. With the continued application of heat absorption, the stall temperature decreases to the aforementioned half cycle of the process until the switch 20 is actuated to remain closed when the sensor 19 detects a drop to 29° F., for example, thereby energizing solenoid 18 to open the normally closed bypass valve 15 so that hot gas enters through the evaporator 13. Note that the hot gas bypass 14 opens into the outlet line 22 intermediate the thermo expansion valve 12 and evaporator 13, so that the least flow resistance assures gas flow through the evaporator.

Simultaneously with the opening of valve 15 as above described, the water supply is opened or energized by closing of switch 20 so that water under pressure is supplied into the stall through orifice 33. The instant that the ice is thawed and free from the wall 30, there is floatation of the ice in the stall. The flow rate of water established by orifice 33 is greater than the flow rate between the ice and the wall 30, and consequently the ice is ejected by displacement action of hydraulics to the position shown in FIG. 6, as is a piston or ram, where its center of gravity over balances the dipped rim of the stall. Consequently, the ice then tumbles by gravity from the stall as is indicated by arrow b. With the continued application of heat, the stall temperature increases to the aforementioned full cycle of the process until the switch 20 is actuated to remain open when the sensor 19 detects said 49° F., for example, thereby initiating a subsequent cycle of operation.

Batch production of multi-form ice is much to be desired, and accordingly heat absorption and heating is applied progressively to a series of stalls S for the continuous batch production of ice, as illustrated in FIG. 1. The evaporator 13 is coextensively adapted to a series of stalls S, and it is to be noted that expansion in the evaporator 13 is from left to right, for example, in which case freeze maturity of ice is also from left to right. Consequently, the order of ice maturity is from the stalls numbered 1 to 6 as indicated, and likewise the order of interface thawing is from left to right in the order 1 to 6. As shown, the water supply includes a manifold 35 in open communication with the multiplicity of orifices 33, supplied with water through a solenoid actuated valve 36 from a constant pressure water supply such as a pump 37, at for example 2½ pounds pressure through orifices 33 of 1/16 diameter when forming ice of ½ inch diameter. It will be seen that there is a progressive maturing of ice followed by a progressive thawing and ejection of ice, after which the stalls are refilled and prepared for a subsequent cycle of operation.

In accordance with this invention, the sensor 19 is adjustably positioned at an optimum point of maturity related to both icing and thawing. In practice, the sensor is positioned at approximately ⅔ the distance from stall 1 to stall 6, although this distance will vary with different stall design and arrangements thereof. However, actual reduction to practice has shown that the integral interconnection of stalls S and the integral embracement of the evaporator 13 along one side thereof, dimensioned as indicated, operates most satisfactory with the sensor 19 remotely positioned as shown and described, the evaporator being positioned high at one side of the stalls and the sensor low at the other side thereof.

Referring now to FIGS. 7 and 8 of the drawings, there are two rows of stalls S, all of which are in series and embraced by a common continuing evaporator 13 with an inlet 22 and outlet 23, and the manifold 35 is a continuous loop for equalized pressure application and adapted to function as a frame disposed longitudinally within the super-structure 28, as shown in FIG. 2.

The harvest of ice after each full cycle of the process is by means of a declined screen 40 underlying the ice maker C. Screen 40 is horizontally disposed and extends through the opening 26, so that ice falls or rolls by gravity into the bin B. A feature of this invention is the physical properties of the screen 40 and namely the low thermo conductivity thereof as it is formed of a plastic material such as polypropylene, or the like, through which expended floatation water drops through the screen 40 to be collected in a trough 41′ and passed through a drain 42 to a storage tank 43 having a float controlled supply valve 44 that restricts water inlet from a water supply 21. By providing a screen 40 of low thermal conductivity, freezing and collection of water therein does not occur as the screen per se does not conduct heat into the bin into which it extends or is closely related. The water supply can be direct to the solenoid valve 36 when the said supply is of suitably constant pressure, but preferably is through the pump 37 from a constant float control lever in tank 43, assuring a constant pressure at the orifice 33.

The controlling switch 20 is in a power line to the solenoid valves 15 and 36 and to the pump 37 when employed. It is also to be understood that valve 36 can be a simple check valve when a pump 37 is used. The system can be operated continuously or preferably on a demand basis until the bin B is filled with ice, in which case the motor 16 and aforementioned valve and switch circuitry is energized through a control switch 41 actuated by a sensor 42 responsive to ice touching the same at the brim of the bin B adjacent the opening 26. In practice, the sensor 42 opens the switch 41 at 30° F., and closes the same at 33° F., or at any similar range of temperature as circumstances require.

This ice making process is carried out efficiently by the machine hereinabove described, a machine that is automatic and operative within a wide range of surrounding temperature to produce large quantities of ice on demand, and ceasing to operate when filled to capacity. The bin is a cold storage sink in which the cold settles at the temperature maintained by the ice supplied thereto to fill the same. A feature of this invention is the embodiment thereof in a method and apparatus wherein there is a high differential of thermal inertia between the refrigeration system and the heat absorption unit, and which results in the capability of high ambient operation with a high rate of production. The differential in thermal inertia has to do with the thermal output capacity of the refrigeration system such as that which is shown comprising a compressor 10 and condensor 11 supplying refrigerant through an expansion valve 12, and with the total thermal absorption capacity of the ice maker C with its water content converted to ice. Heretofore, the refrigeration systems and ice makers have been selected for a balance of capability, one being of approximately the same thermal capability as the other so as to be in equilibrium. As an example, a balanced prior art refrigeration system and evaporator unit of ¼ HP rating produces 50–60 lbs. of ice per 24 hr. period at 80° F. ambient. However in contrast, the present method of high inertia differential, by reducing the evaporator (total ice maker) capacity of inertia by a ratio of 20 to 1, a compressor-condensor unit of ¼ HP rating produces 200 lbs. of ice per 24 hr. period at 80° F. ambient; 300 lbs. at 100° F.; and 500 lbs. at 120° F. Whereas a prior art evaporator used with a ¼ HP compressor-condensor requires 5 to 7 lbs. of refrigerant for flooding, the evaporator used in the method and apparatus herein disclosed requires but 8 oz. of refrigerant. Therefore, it will be observed that efficiency is increased with a rise in the ambient temperature and to the end that the ice producing capacity can be increased as for example by exposure of the ice maker C to sunlight. Thus, it will be seen that the high inertia differential and high ambient operation is conducive to high production of ice when employing the method and apparatus of the present invention.

Having described only a typical preferred form and application of my invention, I do not wish to be limited or restricted to the specific details herein set forth, but wish to reserve to myself any modifications or variations that may appear to those skilled in the art:

Having described my invention, I claim:

1. An apparatus for automatically producing multi-form ice and comprising, a series of first to last stalls to be simultaneously filled with water, means alternately absorbing heat progressively from said first to last stalls for progressive ice maturity and progressively applying heat to said first to last stalls for progressive thawing, a water supply means applying floatation water into the stalls at a flow rate greater than the flow rate of water between the ice-to-stall interfaces when the ice is thawed, and a temperature sensor and control means selectively positioned at said last stalls and responsive to thawing and operatively coupled to said first mentioned means activating the same to absorb heat until said last stalls are iced and responsive to freezing and operatively coupled to said first mentioned means activating the same to apply heat until the ice-to-stall interfaces at said last stalls are thawed and operatively coupled to said water supply means activating the same to apply water into the stalls at said greater flow rate to float and eject the thawed ice therefrom.

2. Apparatus for producing multi-form ice as set forth in claim 1 wherein the water and supply means applies floatation water under pressure beneath the ice formed in the stalls.

3. Apparatus for producing multi-form ice as set forth in claim 1 wherein the water supply means applies floatation water under pressure through an orifice beneath the ice formed in the stalls.

4. Apparatus for producing multi-form ice as set forth in claim 1 wherein the stalls are open topped with parallel side walls for uniform flow rate of floatation water between the ice-to-stall interfaces and a bottom with an orifice opening therethrough from the water supply means.

5. Apparatus for producing multi-form ice as set forth in claim 1 wherein the stalls are open topped with side walls parallel to an axis displaced from vertical for uniform flow rate of floatation water between the ice-to-stall interfaces and a bottom with an orifice opening therethrough from the water supply means, to float the thawed ice for ejection over the dipped side of the stalls.

6. Apparatus for producing multi-form ice as set forth in claim 1 wherein the water supply means applies floatation water under pressure beneath the ice formed in the stalls and wherein the stalls are open topped with parallel side walls for uniform flow rate of floatation water between the ice-to-stall interfaces and a bottom with an orifice opening therethrough from the water supply means.

7. Apparatus for producing multi-form ice as set forth in claim 1 wherein the water supply means applies floatation water under pressure beneath the ice formed in the stalls and wherein the stalls are open topped with side walls parallel to an axis displaced from vertical for uniform flow rate of floatation water between the ice-to-stall interfaces and a bottom with an orifice opening therethrough from the water supply means, to float the thawed ice for ejection over the dipped side of the stalls.

* * * * *